US005520797A

United States Patent [19]

Ino et al.

[11] Patent Number: 5,520,797

[45] Date of Patent: May 28, 1996

[54] FLUID CATALYTIC CRACKING WITH A ZINC FERRITE-CONTAINING CATALYST

[75] Inventors: Takashi Ino; Koichi Kato; Yasuo Nakatsuka, all of Yokohama, Japan

[73] Assignee: Nippon Oil Co., Ltd., Tokyo, Japan

[21] Appl. No.: 202,829

[22] Filed: Feb. 28, 1994

[30] Foreign Application Priority Data

Mar. 2, 1993 [JP] Japan ..... 5-064804

[51] Int. Cl.[6] ..... C10G 11/04; C10G 11/02

[52] U.S. Cl. ..... 208/113; 208/120; 208/121; 208/124; 208/152

[58] Field of Search ..... 208/113, 120, 208/121, 124, 152

[56] References Cited

U.S. PATENT DOCUMENTS

| | | | |
|---|---|---|---|
| 2,635,749 | 4/1953 | Cropper et al. | 208/120 |
| 2,723,997 | 11/1955 | Reynolds et al. | 568/456 |
| 4,359,379 | 11/1982 | Ushio et al. | 208/120 |
| 4,406,773 | 9/1983 | Hettinger, Jr. et al. | 208/120 |
| 4,482,450 | 11/1984 | Ushio et al. | 208/152 |
| 5,106,486 | 4/1992 | Hettinger | 208/124 |
| 5,147,527 | 9/1992 | Hettinger | 208/120 |
| 5,171,424 | 12/1992 | Hettinger | 208/121 |
| 5,190,635 | 3/1993 | Hettinger | 208/113 |
| 5,198,098 | 3/1993 | Hettinger | 208/85 |
| 5,230,869 | 7/1993 | Hettinger et al. | 208/120 |

FOREIGN PATENT DOCUMENTS 9112298 8/1991 WIPO .

OTHER PUBLICATIONS

Hackh's Chemical Dictionary, 1944, p. 797.

*Primary Examiner*—E. Rollins Cross
*Assistant Examiner*—Walter D. Griffin
*Attorney, Agent, or Firm*—Bucknam and Archer

[57] ABSTRACT

A process for the fluid catalytic cracking of heavy fraction oils containing heavy metals such as Ni and V, which comprises withdrawing a portion of ferrite-containing catalyst particles circulating in a fluid catalytic cracking apparatus, separating the thus withdrawn catalyst particles into metals-richly deposited catalyst particles and metals-poorly deposited ones by using a magnetic separator and then returning the metals-poorly deposited catalyst particles, together with fresh ferrite-containing catalyst particles, into said cracking apparatus.

14 Claims, 2 Drawing Sheets

FLUID CATALYTIC CRACKING WITH A ZINC FERRITE-CONTAINING CATALYST

BACKGROUND OF THE INVENTION

1. Field of the Invention

This invention relates to an improved fluid catalytic cracking process which comprises cracking heavy fraction oils to obtain therefrom light fraction oils such as gasoline and kerosene. More particularly, it relates to such a process which comprises catalytically cracking, in the presence of a particulate iron oxide (ferrite)-containing catalyst, heavy fraction oils including 0.5 ppm or more in total of at least nickel and vanadium among heavy metals such is as particularly nickel, vanadium, iron and copper, separating a portion of the particulate catalyst with the heavy metals deposited thereon in a high concentration (the catalyst portion being magnetically attachable catalyst particles) from an equilibrated particulate catalyst produced from said iron oxide-containing particulate catalyst during its use, by the use of a magnetic separator, and then recycling to the system another portion of the particulate catalyst with the heavy metals deposited thereon in a low concentration (the other catalyst portion being magnetically unattachable catalyst particles), together with a particulate ferrite-containing catalyst as a makeup or replenishment, so that it is possible to maintain the performance of the apparatus for carrying out said process at a high level.

2. Prior Art

In conventional catalytic cracking, petroleum derived hydrocarbons are contacted with a catalyst for cracking so as to obtain a large quantity of light oil fractions such as LPG and gasoline as well as a small quantity of a cracked light oil, and, further, coke deposited on the catalyst is burnt with air for removal thereof to recyle the thus treated catalyst for reuse. As starting oils in this case, there have heretofore been mainly used so-called distillates such as a light gas oil (LGO) and heavy gas oil (HGO) from an atmospheric-pressure distilling column and a vacuum gas oil (VGO) from a reduced-pressure distilling column.

However, due to the recent world-wide necessity of using heavier crude oils and a change in demand for petroleum products in our country, a tendency of overproduction of heavy oils and the like has been appreciated from the standpoint of both demand and supply of the petroleum products; and therefore, it has been necessary that heavy fraction oils including distillation residues be used as starting oils for use in a catalytic cracking process.

It is known, however that heavy fraction oils including distillation residues contain metals such as nickel, vanadium, iron, copper and sodium in a far greater total amount than distillates, and that these metals will be deposited on a catalyst so that they hinder the activity and selectivity of the catalyst when the catalyst is used in catalytic cracking. In other words, the cracking rate will gradually decrease as the metals accumulate on the catalyst so that it is substantially impossible to attain a desired cracking rate, while the amount of hydrogen evolved and the amount of coke produced will remarkably increase thereby making it difficult to operate equipment for carrying out the cracking. Further, at the same time, desired liquid products will be obtained in a decreased yield. Among said metals, particularly vanadium will destroy zeolite which is the active component of the catalyst so that the catalytic activity is lowered. Nickel has no action which decreases the catalytic activity as vanadium does, but it will remarkably increase hydrogen and carbon due to its dehydrogenating catalytic activity.

To relieve such effects of the contaminating metals on the catalyst in the system, there has usually been employed a process which comprises withdrawing periodically or continuously a portion of the particulate equilibrated catalyst present in the system and, instead, replenishing a necessary amount of a fresh particulate catalyst therein, whereby the activity of the equilibrium catalyst is maintained. In this case, it is necessary that the particulate catalyst be withdrawn in a remarkably large amount, this being very economically disadvantageous and raising a serious problem particularly in case of the fluid catalytic cracking of a residual oil containing metals in a large amount.

As measures for solving this problem, a method for removing metals deposited on catalysts and a method for inhibiting the activity of the metals are known. For example, as the above removing method, there has been proposed a method for chemically treating the withdrawn equilibrium catalyst to remove the heavy metals therefrom for reuse of the thus treated catalyst (F. J. Elvin et al, NPRA Annual Meeting, AM-86-41). The method so proposed will inevitably discharge a large amount of waste liquid which requires substantial expenses from the standpoint of preventing environmental pollution.

As the above inhibiting method, a method which comprises adding a metal scavenger to the catalyst and a method which comprises adding to a starting oil a metal passivator such as antimony (U.S. Pat. Nos. 3,711,422 and 4,025,458) or bismuth (U.S. Pat. Nos. 4,083,807 and 3,977,963)are known. In addition, it is known that alkaline earth metal compounds are effective as the metal passivators (for example, Japanese Pat. Appln. Laid-Open Gazettes Nos. Sho 61-204041, Sho 60-71041, Sho 61-278351 and Sho 63-123804).

Even in these methods, it is not possible yet to fully prevent the contaminating metals from exerting their effects. Accordingly, in order to maintain the activity of the catalyst, it is necessary to withdraw the equilibrated catalyst partly from the system and, instead, a necessary amount of a fresh catalyst has to be replenished. When said catalyst exchange is effected, a portion of the equilibrium catalyst particles to be withdrawn contain those having still high catalytic activity. Thus, it follows that said catalyst exchange method uses the catalyst inefficiently.

The present inventors of this application have already found that a portion of the particulate equilibrated catalyst on which the heavy metals are deposited is withdrawn from the system, the catalyst so withdrawn is separated by the use of a highly gradient magnetic separator into one catalyst portion on which more metals are deposited and the other one on which less metals are deposited and the less metals-deposited catalyst portion is then recycled to the system, whereby the activity of the equilibrated catalyst is enhanced and the selectivity thereof is remarkably improved (Japanese Patent Gazettes Nos. 63-37156 and 3-37835). This technique disclosed in said Gazettes never conflicts with anti-metal measures such as the above-mentioned chemical treatment, metal scavengers and metal passivators and can be used together with them. In such a method which comprises separating the equilibrated catalyst by the use of a magnetic separator into a more metal deposited portion and a less metal deposited portion, it is important how to effect such separation precisely depending on the concentrations of metals deposited on the particulate catalyst, and the separation can be achieved more effectively as the difference in magnetizabillty (magnetic susceptibility) is greater between the more metal deposited catalyst particles and the less metal deposited ones.

SUMMARY OF THE INVENTION

The prime object of this invention is to provide a fluid catalytic cracking process which comprises catalytically cracking heavy fraction oils containing a large amount of heavy metals such as nickel and vanadium while lessening a decrease in catalytic activity of the catalyst due to the presence of the heavy metals.

The present inventors made intensive studies mainly in attempts to improve the separability of catalyst particles into more metal deposited particles and less metal deposited ones by the use of a magnetic separator in a combination of fluid catalytic cracking of heavy fraction oils with magnetic separation of the above catalyst particles, and as the result of their studies they found that the object may be achieved by the use of a specified catalyst. This invention is based on the above finding.

The object may be attained by providing a process for the fluid catalytic cracking of heavy fraction oils containing nickel and vanadium in the total amount of at least 0.5 ppm, which comprises withdrawing a portion of particulate ferrite-containing catalyst particles flowing circulatively in a fluid catalytic cracking apparatus provided with a reaction zone, a separation zone, a stripping zone and regenerating zone the particulate ferrite initially having a saturation magnetization of not more than 10 emu/g, separating the equilibrated catalyst particles so withdrawn into magnetically attachable catalyst particles and magnetically unattachable ones by the use of a magnetic separator and then returning the magnetically unattachable catalyst particles, together with fresh particulate ferrite-containing catalyst particles, in which the particulate ferrite has a saturation magnetization of not more than 10 emu/g, into said cracking apparatus. The unit "emu/g" means an electromagnetic unit (e.m.u.) per one gram of ferrite. Further, the term "ferrite" refers to oxides containing iron as a major metallic component, which are generally represented by $MFe_2O_4$, in which M is a divalent metal ion.

This invention will be explained hereunder in more detail.

The heavy fraction oils used herein are hydrocarbon oils which contain at least 5 vol. % of fractions boiling at 565° C. or higher, have a density of at least 0.8 g/cm$^3$ at 15° C. and further contain heavy metals such as iron, nickel, vanadium and copper, among which at least nickel and vanadium are contained in a total amount of at least 0.5 ppm. They may be illustrated by atmospheric-pressure distillation residues, reduced-pressure distillation residues, shale oils, tar sand bitumen, Orinoco tar, coal liquefied oils, and heavy fraction oils obtained by the hydrofining thereof. They further include mixtures of comparatively light fraction oils (such as straight-run light oils, reduced-pressure light oils, desulfurized light oils and desulfurized reduced-pressure light oils) with the above-illustrated heavy fraction oils. The atmospheric-pressure distillation residues and reduced-pressure distillation residues are particularly preferred for use in this invention. In cases where heavy fraction oils containing nickel and vanadium in a total amount of preferably at least 2 ppm, more preferably at least 5 ppm, are used as the starting oils in this invention, then the cracking process of this invention will exhibit greater economical merits.

The catalyst used in this invention comprises zeolite which is an active component and a matrix which supports the zeolite. The matrix carries ferrite particles having a saturation magnetization of not more than 10 emu/g, preferably 1–4 emu/g, dispersed therein. When the heavy fraction oils are subjected to fluid catalytic cracking using such a ferrite-containing catalyst, nickel contained in the heavy fraction oils will precipitate on the catalyst where the ferrite 10 particles react with the precipitated nickel to produce nickel ferrite particles having a saturation magnetization of over 10 emu/g. Accordingly, in the case where the ferrite particles have a saturation magnetization of more than 10 emu/g, a difference in saturation magnetization between the ferrite particles and the nickel ferrite particles becomes small whereby selectivity of metal deposited catalysts by magnetic separation is undesirably worsened. The ferrite particles may be illustrated by zinc ferrite particles and they have an average particle size of preferably 0.001–20 μm, more preferably 0.01–5 μm. In addition, the content of the ferrite particles in the catalyst is preferably 0.01–10 wt. %, more preferably 0.1–5 wt. %. The zeolite contained as the active component in the catalyst used in this invention is crystalline aluminosilicates among which faujasite-type zeolite is preferably used and ultrastable Y-type zeolite is particularly preferably used. The content of the zeolite in the catalyst is preferably 5–50 wt. %, more preferably 15–45 wt. %. The matrix which is the mother body supporting the above ferrite particles and zeolite is composed of a catalytically inert extender such as kaolin, and a binder such as alumina sol or silica sol; it may be incorporated with alumina, a metal scavenger and the like as required.

It is preferable that the catalyst particles used in this invention have a bulk density of 0.5–1.0 g/ml, an average particle size of 50–90 μm, a surface area of 50–350 m$^2$/g and a pore volume of 0.05–0.5 ml/g.

The fluid catalytic cracking apparatus used in this invention is provided with a reaction zone, separation zone, stripping zone and catalyst regeneration zone, and it is usually operated at a reaction temperature of 480°–550° C., a pressure of 1–3 kg/cm$^2$G, a catalyst/oil ratio of 1–20 and a contact time of 1–10 seconds.

The "fluid catalytic cracking" defined herein means that the heavy fraction oils (feed oils) are continuously contacted with the catalyst particles kept fluidized therewith under the above operational conditions so that the heavy fraction oils are cracked into lighter hydrocarbon oils such as LPG, gasoline, kerosene and light oil. Said contact may be effected either within fluid beds of the catalyst or in risers through which both the catalyst particles and feed oils flow upward for so-called riser cracking. A mixture of products and unreacted substances produced by the catalytic cracking, with the catalyst particles is usually passed to the stripping zone where the greater part of the hydrocarbons such as the products and unreacted substances are removed from the catalyst particles. The catalyst particles to which the carbonaceous substances and a part of the heavy hydrocarbons are attached are passed from the stripping zone to the regeneration zone (regenerating tower) where they are subjected to oxidizing treatment to decrease the amount of the carbonaceous substances and hydrocarbons deposited thereon, so as to obtain regenerated catalyst particles. These regenerated catalyst particles are continuously recycled to the reaction zone.

In the fluid catalytic cracking process of this invention, the catalyst particles circulated from the reaction zone to the regeneration zone (such circulating catalyst being sometimes called "equilibrated catalyst" herein) are partly withdrawn through the stripping zone outlet, the regenerating zone outlet or other suitable outlets which have no hindrance to the operation of the apparatus used in this invention. In this case, the withdrawal of a part of the equilibrated catalyst may be effected continuously or discontinuously at such a fixed interval as to exert no adverse effects on the resulting products. The catalyst so withdrawn may be subjected directly to magnetic separation using a magnetic separator or may be subjected to some suitable treatment before the magnetic separation.

The magnetic separator used herein is a high gradient one having a magnetic field gradient of at least 200 gauss/cm, preferably $2000\times10^3$–$20000\times10^3$ gauss/cm. The high gradient magnetic separator is designed such that a ferromagnetic packing material is placed within a uniform highly magnetic field space to constitute such a high magnetic field gradient as above around said packing material, ferromagnetic or paramagnetic particles are magnetically attached to the surface of said magnetic substance, and weakly magnetic or diamagnetic particles can be separated as magnetic unattached particles. The ferromagnetic packing material used herein is exemplified by a ferromagnetic fine wire assembly such as steel wool or steel net composed of fine wires having a diameter of usually 1–1000 μm. The high gradient magnetic separator is exemplified by that manufactured and sold by SALA Company, Sweden.

Methods for treating solid fine particles by the use of a magnetic separator include a dry method which comprises using, as a carrier fluid, any one of air, nitrogen, steam and a mixture thereof and a wet method which comprises using, as a carrier fluid, any one of water and other liquids. Either the dry method or the wet method may be used in the practice of this invention.

The process variables in the operation of the magnetic separator usually include magnetic field intensity, magnetic field gradient, linear velocity, concentration of particles, and treating temperature, and they will widely vary in their optimum value depending on the particle size of catalyst, the kind, condition and amount of metals deposited, the particle size and amount of iron oxide particles contained in the catalyst, the level of separation intended, the selectivity of separation, and the like.

The magnetic field strength is the intensity of magnetic field within the space in which said magnetic packing material is placed, and a magnetic field intensity of at least 200 gauss, preferably 1000–20000 gauss or more, is used in both the dry method and the wet method.

The magnetic field gradient is such an amount of magnetic field intensity produced around said packing material as to vary depending on a distance within the magnetic field. This variation can be effected by changing the intensity of magnetic field or the kind and diameter of said packing material, and the magnetic field gradient used in both the dry and wet methods is at least 200 gauss/cm, preferably $2000\times10^3$–$20000\times10^3$ gauss/cm.

A concentration of particles means that of catalyst particles which are to be magnetically separated in a gaseous or liquid carrier fluid, and the suitable concentration of catalyst particles is usually 0.01–100 g/l in the dry method and usually 0.01–1000 g/l in the wet method.

The treating temperature refers to the temperature of catalyst particles which are to be subjected to magnetic separation, and, strictly speaking, it refers to the temperature of iron, nickel, vanadium or copper which is deposited on the catalyst particles. The treating temperature used is preferably not higher than the respective curie temperatures of these metals and is usually a normal temperature.

It is possible to widely change the level of separation and the selectivity of separation by changing the linear velocity of the fluid passing through the magnetic field, and the linear velocity is increased when high selectivity is required. The linear velocity used is usually 0.01–100 m/sec in the dry method, and is usually 0.01–10000 m/hr in the wet method.

The magnetic separator may be cut-in on the line of the fluid catalytic cracking apparatus or may be used batchwise without being so cut in.

The catalyst particles (equilibrated catalyst) withdrawn are separated by the magnetic separator into metal-rich catalyst particles (magnetically attachable catalyst particles) on which iron, nickel, vanadium and copper are deposited in large amounts, and metal-poor catalyst particles (magnetically unattachable catalyst particles) on which such metals are deposited in comparatively small amounts. The weight ratio between the metal-rich catalyst particles and the metal-poor ones so separated is usually in the range of from 1: 100 to 100: 1, in some cases from 1:1000 to 1000:1, and preferably from 1:10 to 10:1.

The amount of metals deposited on the metal-rich catalyst particles will greatly vary depending on the amount of catalyst used, the properties of feed oils used, the reaction conditions and the like in the fluid catalytic cracking reaction, and is at least 0.05 wt. %, preferably 0.05–20 wt. % and more preferably 0.1–5 wt. %, as nickel equivalent. The "nickel equivalent" defined herein is a value represented by the following formula $$Ni\ \text{equivalent}=[Ni]+0.25\times[V]$$

wherein [Ni]and [V] are the concentrations of nickel and vanadium, respectively.

The metal-poor catalyst particles separated have still high activity and, therefore, they are returned to the circulating system for recycle. It is usually customary in this case to maintain the amount of catalyst at a desired level while preventing the activity of catalyst from lowering in the circulating system by replenishing the fresh or regenerated catalyst in an amount equal to or more than that of the separated and removed metal-rich catalyst. As sites through which the catalyst is charged into the circulating system, there are selected the regenerating tower inlet, the regenerating tower outlet transfer line or other sites which have little effects on the heat balance and fluidity balance in the system.

The metal-rich catalyst particles separated and removed may be scrapped or may be subjected to ion exchange, chlorination, sulfurizatlon, carbonylation, oxidation, reduction or the like thereby to detach the deposited metals from the catalyst particles for reuse thereof. In this catalyst regeneration, the regeneration device may be connected to the magnetic separator thereby to be cut-in on the line for the cracking or may be operated batchwise without being so cut-in.

DESCRIPTION OF THE PREFERRED EMBODIMENTS

Figure 1:
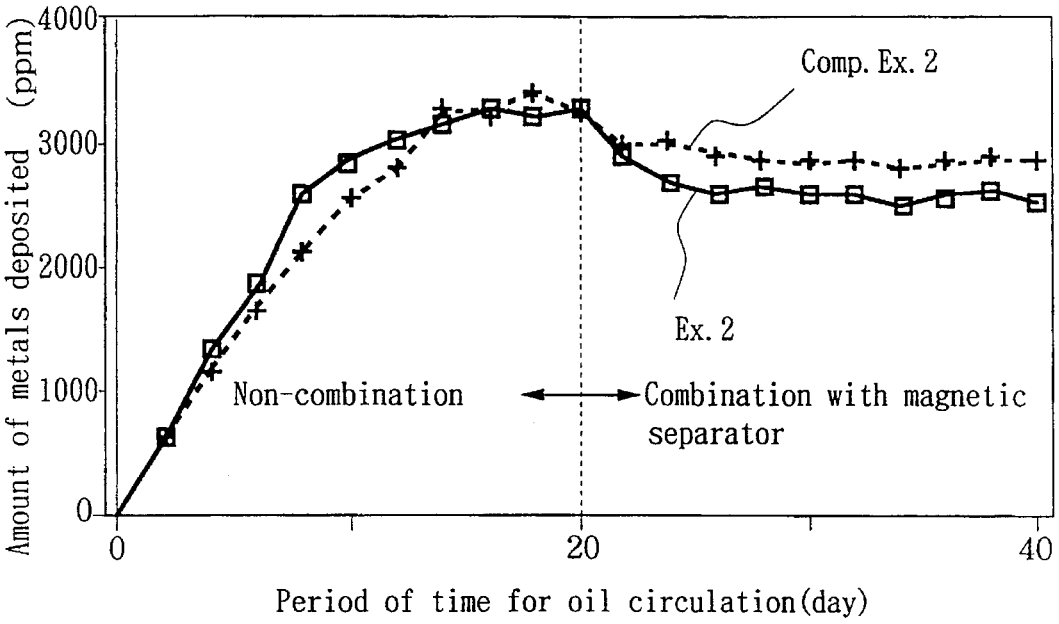
FIG. 1 is a graph showing the relationship between the number of days for oil circulation and the amount of metals deposited in case of Example 2 and Comparative Example 2.

This invention will be better understood by the following non-limitative Examples and Comparative Examples.

EXAMPLE 1

2155g of a diluted solution ($SiO_2$ concentration, 11.6%) of water glass, JIS No.3 were added dropwise to 337g of 40% sulfuric acid to obtain silica sol having a pH value of 3.0. The whole of the silica sol obtained was incorporated with 350g of ultrastable Y-type zeolite (lattice constant 2.450 nm, tradename TSZ-330 HSA produced by Toso Co., Ltd., Japan), 390 g of kaolin and 10 g of zinc ferrite (average particle size: 2.2 μm) having a ferromagnetization of 1.8 emu/g, thereafter kneaded together and then spray dried by heated air at 250° C. The thus obtained spray dried product was washed with 5 liter of 0.2% ammonium sulfate at 50° C., thereafter dried in an oven at 110° C. and then further calcined at 600° C. to obtain a catalyst (A).

Then, 1.0 wt. % of nickel was carried in the catalyst (A) according to the Mitchell's method (Ind. Eng. Chem., Prod. Res. Dev., 19, 209 (1980)). More particularly, the catalyst (A) was impregnated with a solution of nickel naphthenate in toluene, after which the solvent was evaporated and the resulting solvent-free catalyst was then calcined in air at 550° C. for 3 hours, followed by being subjected to steaming at 800° C. for 6 hours. In, addition, a catalyst which was the same as the catalyst(A) but did not carry nickel was likewise subjected to steaming at 800° C. for 6 hours.

The magnetizabilities of these catalysts so obtained were determined by the following formula using a magnetic balance (tradename: magnetic balance NB-2 produced by Shimazu Seisakusho Co., Ltd., Japan). The results are as shown in Table 1.

$$F = m \cdot \chi \cdot \frac{dH}{dx}$$

F: magnetic force(dyn), m: mass (g)

X: magnetizability (emu/g), H:magnetic field intensity(Oe)

dH/dx: magnetic field gradient (Oe/cm)

Comparative Example 1

A commercially available catalyst (Octacat produced by W. R. Grace Company) was made to carry 1.0 wt. % nickel therein in the same manner as in Example 1. The nickel-carried catalyst so obtained and a nickel-free catalyst which was the same as the above commercially available catalyst were each subjected to steaming at 800° C. for 6 hours and then measured for their magnetizabillty in the same manner as in Example 1. The results are as shown in Table 1.

TABLE 1

| Catalyst | Catalyst (A) | | Commercially available catalyst (Octacat) | |
|---|---|---|---|---|
| Nickel (wt. %) | 0 | 1 | 0 | 1 |
| Magnetizability ($10^{-6}$ emu/g) | 6.4 | 10.3 | 0.4 | 1.4 |

EXAMPLE 2

Using a scaled-up apparatus for producing a catalyst, 100kg of catalyst(A) were produced in the same manner as in Example 1. The catalyst(A) was evaluated using a riser-type FCC pilot plant. The scale of the plant was expressed as an inventory of 40 kg (of catalyst) and a feed of 1 bbl/D, and the plant was operated at a reaction temperature of 520° C., a catalyst/oil ratio of 8 and a regenerating tower temperature of 700°–710° C. The feed oils were a mixture of 50 wt. % of Taching (Taihei) atmospheric-pressure residual oils with 50 wt. % of desulfurized HVGO, and a metal naphthenate was injected into the feed to accelerate the deposition of metals on the catalyst particles. The amount of metal naphthenate injected was 85 ppm of Ni and 8.5 ppm of V based on the feed. Before the catalyst(A) was charged into the apparatus, it had been subjected to steaming with 100% steam at 800° C. for 6 hours in order to pseudo-equilibrate the catalyst.

The fluid catalytic cracking operation was operated for 20 days under the above conditions and additional conditions that the makeup of fresh catalyst was 0.4 kg/D, the makeup of pseudo-equilibrated catalyst was 3.8 kg/D, the loss of catalyst scattered was 0.8 kg/D and the amount of equilibrated catalyst withdrawn was 3.4 kg/D. Thereafter, the cracking apparatus was combined with a magnetic separator and operated for additional 20 days.

After the combination with the magnetic separator, the makeups or replenishments of the fresh catalyst and pseudo-equilibrated catalyst, as well as the loss of catalyst scrapped were still the same as before said combination. In addition, while the cracking apparatus was combined with the magnetic separator, 16 kg/D of the equilibrated catalyst particles were treated with the magnetic separator to separate them into 3.4 kg/D of metal-rich (magnetically attachable) catalyst particles and 12.6 kg/D of metal-poor (magnetically unattachable) ones, after which the former (metal-rich) particles were scrapped and the latter (metal-poor) particles were returned to the apparatus. At this time, the magnetic separator was operated under the conditions of a magnetic field intensity of 13 KG, a carrier air velocity of 1.7 m/s, a particle concentration of 0.5g/l and the treating temperature being normal temperature.

Figure 2:
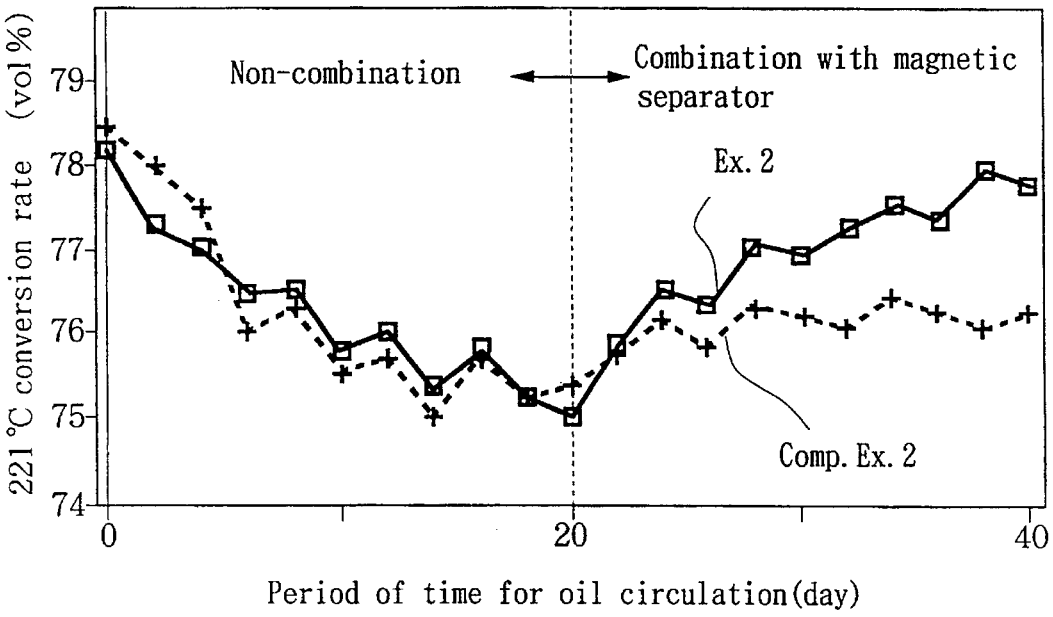
FIG. 2. is a graph showing the relationship between the number of days for oil circulation and the 221° C. conversion.
Figure 3:
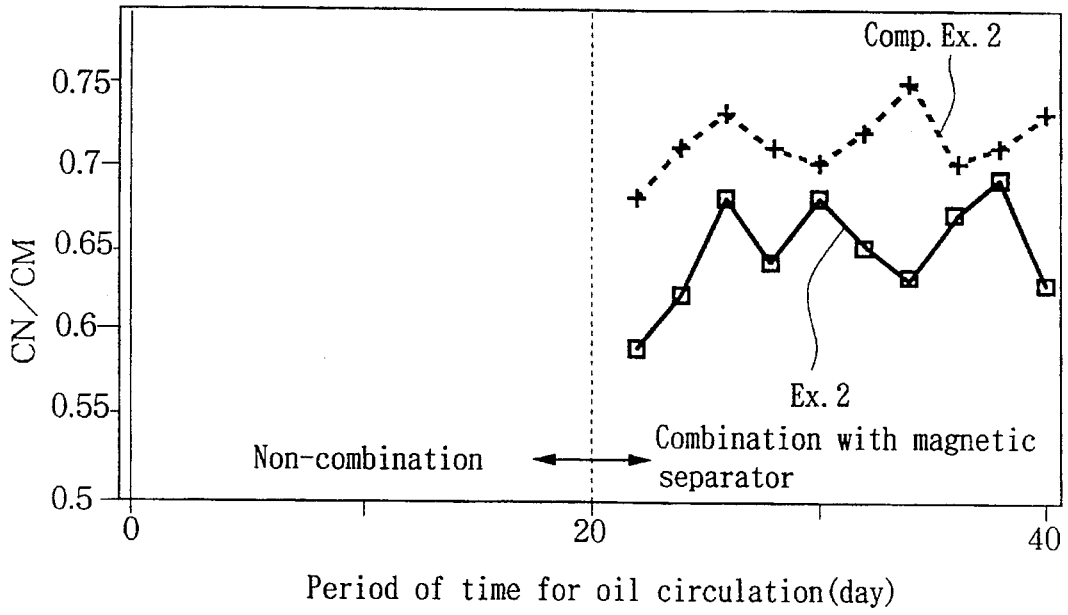
FIG. 3. is a graph showing the relationship between the number of days for oil circulation and the ratio (CN/CM) of the Ni concentration (CN) of the metal-poor catalyst particles to the Ni concentration (CM) of the metal-rich catalyst particles.

FIGS. 1–3 indicate "amounts of metals deposited on equilibrated catalyst", "221° C. conversion" and "ratio (CN/CM) between Ni concentration of magnetically unattachable catalyst particles (CN) and Ni concentration of magnetically attachable ones (CM)", versus "oil circulation time period", respectively. Further, Table 2 indicates data for 20 days' oil circulation (without combination with magnetic separator) and data for 40 days' oil circulation (under combination with magnetic separator).

Comparative Example 2

The commercially available catalyst (OCTACAT) was evaluated in quite the same manner as in Example 2 by the use of said pilot plant. The results are as indicated in FIGS.1–3 and Table 2.

TABLE 2

| | Catalyst (A) | | Commercially available catalyst (OCTACAT) | |
|---|---|---|---|---|
| Days for oil circulation | 20 | 40 | 20 | 40 |
| Magnetic separation | Non-combination | Combination | Non-combination | Combination |
| Amount of metals deposited (ppm) | 3200 | 2400 | 3150 | 2730 |
| 221° C. Conversion (vol. %) | 75.0 | 77.7 | 75.3 | 76.2 |
| Gasoline yield (vol. %) | 58.1 | 59.7 | 58.1 | 58.7 |

TABLE 2-continued

| | Catalyst (A) | | Commercially available catalyst (OCTACAT) | |
|---|---|---|---|---|
| Hydrogen yield (wt. %) | 0.31 | 0.27 | 0.34 | 0.31 |
| Coke yield (wt. %) | 6.01 | 5.89 | 6.26 | 6.17 |

As is seen from the foregoing results, the catalyst (A) containing ferrite particles exhibited more increased magnetizability and better separatability by the magnetic separator than the commercially available catalyst when nickel was deposited on each of said catalysts.

When the same makeup or replenishment of fresh catalyst was effected, the amount of metals deposited on the catalyst subsequently to the combination with the magnetic separator was smaller in cases where the catalyst (A) was used and, consequently, the use of the catalyst (A) increased the conversion rate and gasoline yield while decreasing hydrogen and coke yields.

In addition, as previously mentioned, the process of this invention is advantageous over conventional processes in that it does not need to withdraw such a remarkably large amount of the circulating (equilibrated) catalyst particles as in the conventional processes for replenishing fresh catalyst particles, it therefore eliminates wasteful scrapping of still somewhat effective catalyst particles, it does not have to incur great expenses for disposing of waste liquids which raise environmental pollution since it does not chemically treat the metal-deposited catalyst in liquid phase to remove the metals from the catalyst and it can be operated simply, not complicatedly.

(Effects of this invention)

As explained above, the process of this invention in which the particulate ferrite-containing catalyst is used makes it possible to enhance efficiency and selectivity of magnetic separation, and to maintain the activity and selectivity of the equilibrated catalyst at a high level.

What is claimed is:

1. A process for the fluid catalytic cracking of heavy fraction oils containing nickel and vanadium in the total amount of at least 0.5 ppm by weight in a fluid catalytic cracking apparatus, said apparatus being provided with a reaction zone, a separation zone, a stripping zone and a regenerating zone, which comprises the steps of (i) continuously subjecting said heavy fraction oils to contact with particulate zinc ferrite-containing catalyst particles, the particulate zinc ferrite initially having a saturation magnetization of 1 to 4 emu/g, in the reaction zone to crack the heavy fraction oils whereby a hydrocarbon mixture of lighter hydrocarbon oils and unreacted heavy fraction oils is obtained:

(ii) separating the catalyst particles to which carbonaceous substances and a part of the hydrocarbon mixture are attached from the remaining greater part of the hydrocarbon mixture in the separation zone;

(iii) subjecting the catalyst particles thus separated to oxidizing treatment in the regenerating zone to decrease the carbonaceous substances and the hydrocarbon mixture attached, on the catalyst particles, thereby to obtain regenerated catalyst particles;

(iv) continuously recycling the regenerated catalyst particles thus obtained into the reaction zone;

(v) withdrawing a portion of the particulate zinc ferrite-containing catalyst particles flowing circulatively in the fluid catalytic cracking apparatus;

(vi) separating said portion of the catalyst particles so withdrawn into magnetically attachable catalyst particles and magnetically unattachable catalyst particles by the use of a magnetic separator; and then (vii) returning the magnetically unattachable catalyst particles, together with fresh particulate zinc ferrite-containing catalyst particles in which the particulate zinc ferrite has a saturation magnetization of 1 to 4 emu/g, into said cracking apparatus.

2. The process according to claim 1, wherein said particulate zinc ferrite has an average particle size of 0.001–20 μm.

3. The process according to claim 2, wherein particulate zinc ferrite has an average particle size of 0.01–5 μm.

4. The process according to claim 1, wherein the catalyst particles contain the particulate zinc ferrite in an amount of 0.01–10% by weight.

5. The process according to claim 4, wherein the catalyst particles contain the particulate zinc ferrite in an amount of 0.1–5% by weight.

6. The process according to claim 1, wherein the magnetically attachable catalyst particles contain particulate nickel ferrite having a saturation magnetization of over 10 emu/g, said particulate nickel ferrite having been produced by reaction of said particulate zinc ferrite with nickel precipitated on said particulate zinc ferrite-containing catalyst particles.

7. The process according to claim 1, wherein the magnetically attachable catalyst particles are those on which nickel and vanadium have been deposited in an amount of at least 0.05% by weight as nickel equivalent, the nickel equivalent being of a value represented by the following formula $$Ni \text{ equivalent}=[Ni]+0.25\times[V]$$

wherein [Ni] and [V] are concentrations of nickel and vanadium respectively.

8. The process according to claim 1, wherein the catalyst particles have a bulk density of 0.5–1.0 g/ml, an average particle size of 50–90 μm, a surface area of 50–350 $m^2/g$ and a pore volume of 0.05–0.5 ml/g.

9. The process according to claim 1, wherein the fluid catalytic cracking apparatus is operated at a reaction temperature of 480°–550° C., a pressure of 1–3 $kg/cm^2G$, a catalyst/oil ratio of 1–20 and a contact time of 1–10 seconds.

10. The process according to claim 1, wherein the magnetic separator carries out the separation of the catalyst particles in a dry method operated at a magnetic field strength of at least 200 gauss, a magnetic field gradient of at least 200 gauss/cm, a catalyst particles-concentration of 0.01–100 g/l and a linear velocity of 0.01–100 m/sec.

11. The process according to claim 1, wherein the magnetic separator carries out the separation of the catalyst particles in a wet method operated at a magnetic field strength of at least 200 gauss, a magnetic field gradient of at least 200 gauss/cm, a catalyst particles-concentration of 0.01–1000 g/l and a linear velocity of 0.01–10000 m/hr.

12. The process according to claim 1 wherein said heavy fraction oils contain at least 5 vol. % of fractions boiling at 565° C. or higher and have a density of at least 0.8 $g/cm^3$ at 15° C.

13. The process according to claim 1 wherein said catalyst comprises zeolite and a matrix which supports said zeolite, said zeolite being 5–50% by weight, said matrix comprising kaolin and a binder and carrying said zinc ferrite particles.

14. The process according to claim 1 wherein the weight ratio between said magnetically attachable catalyst particles and said magnetically unattachable catalyst particles is 1:10–10:1.

* * * * *